US005938081A

United States Patent [19]

Foster et al.

[11] Patent Number: 5,938,081

[45] Date of Patent: Aug. 17, 1999

[54] CONTAINER AND CAP CLOSURE

[75] Inventors: Donald D. Foster, St. Charles; Philip L. Nelson, Ellisville, both of Mo.

[73] Assignee: Continental Sprayers International, Inc., St. Peters, Mo.

[21] Appl. No.: 08/908,547

[22] Filed: Aug. 7, 1997

[51] Int. Cl.[6] ..... B67D 5/40

[52] U.S. Cl. ..... 222/153.09; 222/383.1; 222/568; 285/391

[58] Field of Search ..... 222/153.09, 383.1, 222/568; 285/391

[56] References Cited

U.S. PATENT DOCUMENTS

| | | | |
|---|---|---|---|
| 1,793,113 | 2/1931 | Metcalf, Jr. | 285/391 |
| 2,169,686 | 8/1939 | Fabrice | 215/46 |
| 3,540,762 | 11/1970 | Dunlap | 285/391 |
| 3,770,153 | 11/1973 | Gach et al. | 215/9 |
| 3,826,395 | 7/1974 | Montgomery | 215/9 |
| 3,941,268 | 3/1976 | Owens et al. | 215/216 |
| 3,989,152 | 11/1976 | Julian | 215/216 |
| 4,260,180 | 4/1981 | Halushka et al. | 285/391 |
| 4,454,965 | 6/1984 | Kirk, Jr. | 222/153.09 |
| 4,630,743 | 12/1986 | Wright | 215/216 |
| 4,781,311 | 11/1988 | Dunning et al. | 222/153.09 |
| 5,169,033 | 12/1992 | Shay | 222/153 |
| 5,238,152 | 8/1993 | Maas et al. | 222/153.09 |
| 5,403,043 | 4/1995 | Smet | 285/391 |
| 5,454,476 | 10/1995 | King et al. | 215/330 |

*Primary Examiner*—Joseph A. Kaufman
*Attorney, Agent, or Firm*—Howell & Haferkamp, LC

[57] ABSTRACT

A closure comprising a cap and container where the cap is integrally formed with a trigger sprayer housing and the cap and container have four thread connectors that attach the cap to the container by a quarter turn of the cap relative to the container, and where the cap also has locking tabs that snap over detents on the container and hold the cap securely to the container preventing unintended separation of the cap from the container.

33 Claims, 2 Drawing Sheets

CONTAINER AND CAP CLOSURE

BACKGROUND OF THE INVENTION

1. Field of the Invention

The present invention pertains to a closure for a cap and container. In particular, the present invention pertains to a cap and container where the cap is integrally formed with a trigger sprayer housing and the cap and container have a four thread closure that attaches the cap to the container by a quarter turn of the cap relative to the container, and where the cap also has locking tabs that snap over detents on the container and hold the cap securely to the container preventing unintended separation of the cap from the container.

2. Description of the Related Art

A trigger sprayer typically comprises a sprayer housing containing a pump chamber, a liquid supply passage communicating with the pump chamber, and a liquid discharge passage communicating with the pump chamber. A dip tube is connected to the liquid supply passage and is extended into the liquid of a container, such as a bottle, when the trigger sprayer is attached to the container to provide fluid communication between the liquid of the container and the trigger sprayer pump. A manually manipulated trigger is mounted on the sprayer housing for pivoting movement. A piston is received in the pump chamber for reciprocating movement and is operatively connected to the trigger, whereby the piston will reciprocate in the pump chamber in response to manual pivoting movement of the trigger. A nozzle is provided at the discharge end of the discharge passage for spraying liquid pumped into the pump chamber through the dip tube and supply passage, and then pumped out of the pump chamber through the discharge passage by the pivoting movement of the trigger.

Many prior art trigger sprayers were attached to their liquid containers by an internally threaded cap that is mounted to the sprayer housing to permit rotational movement of the cap relative to the housing. In order to firmly secure the trigger sprayer on the liquid container, the cap typically would be provided with a single spiraling thread in its interior surface that mated with a complimentary thread provided on the exterior of the container neck. Several revolutions of the cap relative to the trigger sprayer housing and the container were needed to securely attach the trigger sprayer to the container. This prior art method of attaching a trigger sprayer to a liquid container provided a secure closure between the trigger sprayer cap and the container neck that would hold the trigger sprayer stationary relative to the container in its adjusted position and prevent any rocking movement of the trigger sprayer relative to the container when the trigger of the sprayer is operated.

In the production of products contained in liquid containers that employ trigger sprayers of the above-described type in dispensing the products, trigger sprayers would be assembled onto liquid filled containers in a production line. The assembly of the trigger sprayers onto the liquid containers would often require two separate specially designed machines. The first machine would move the trigger sprayer downwardly toward the liquid filled container in a precise movement and insert the dip tube of the sprayer through the container opening while positioning the cap of the sprayer at the top of the container neck. The second machine would then rotate the cap several revolutions while the first machine held the trigger sprayer stationary in its desired orientation relative to the liquid container. Alternatively, an additional portion of the second machine would hold the trigger sprayer stationary while the cap is rotated. These two production steps required elaborately designed machines which at times would perform less than adequately, often making it necessary to manually tighten the trigger sprayer caps on the container necks to ensure they seal properly.

The complexities involved in assembling rotating cap trigger sprayers to the necks of liquid-filled containers resulted in the development of trigger sprayers having bayonet connectors. The basic difference of the bayonet connectors was that instead of employing a screw thread in the cap interior that required the cap to be rotated several times to attach the trigger sprayer to the liquid container neck, the bayonet connector could be moved downwardly onto the container neck and then turned less than one complete turn to securely snap-fit the bayonet connector on the container neck. For some bayonet connectors no rotary movement was necessary and the connector would snap onto the container neck at the end of its downward movement. As a result of the development of the bayonet connector, a single machine could be provided on the production line to move the trigger sprayer downwardly onto the container neck and then rotate the trigger sprayer a fraction of a complete turn to secure the trigger sprayer housing to the container neck.

However, several designs of bayonet connectors were disadvantage in that they did not provide the secure connection between the trigger sprayer and the liquid container provided by the engagement of complimentary screw threads of the trigger sprayer cap and container neck. Bayonet connectors would often permit the trigger sprayer to rock from side to side on the container neck when in use. Also, the prior art design of bayonet connectors often required several openings formed through the connectors that detracted from their appearance. As a result, trigger sprayers employing bayonet connectors were not seen as being desirable or comfortable to use by consumers as trigger sprayers employing a rotating cap closure.

The disadvantages of prior art trigger sprayers discussed above could be overcome by a closure for a cap and a container that enables the cap to be assembled onto the container neck without requiring the cap to be rotated several times in assembling it to the neck, yet still provides a secure connection between the cap and container neck that prevents rocking of the cap relative to the container.

SUMMARY OF THE INVENTION

The present invention provides a closure that may be employed on trigger sprayers, but may also be employed in any environment requiring a cap and container, where the cap is securely assembled to the container neck by rotating the cap less than one complete turn relative to the container neck, and where the closure provides a secure attachment between the cap and container neck that prevents rocking of the cap on the neck.

The closure of the present invention is provided on a cap and a liquid container. In the preferred embodiment, the cap is an integral, monolithic part of a trigger sprayer housing. However, the closure of the invention may be employed on a cap and container combination of any type and it is not necessary that the closure be limited to the cap of a trigger sprayer.

The cap of the closure includes a cylindrical skirt that depends downwardly as an integral extension of the trigger sprayer housing. The skirt has a smooth, continuous exterior surface with no indentations or holes often seen on prior art bayonet connector caps that detract from the pleasing appearance of the cap. Four separate helical screw threads are formed around the interior surface of the cap skirt. The interior surface of the cap skirt is generally cylindrical apart from the presence of the threads, and each of the four screw threads extends around about one-half of the interior circumference of the cap skirt. The bottom of the cap skirt has an annular bottom edge and a pair of resilient tabs project downwardly from the edge. The tabs are positioned diametrically opposite each other on the cap bottom edge. Each of the tabs is bendable from its at rest position where it extends downwardly from the cap edge without extending radially outwardly, to a displaced position of the tab where it is bent and extends both radially outwardly from the cap skirt and downwardly from the skirt bottom edge.

The container has a circular opening at its top and a cylindrical neck surrounding the opening. An annular shoulder surrounds the bottom of the neck and separates the container neck from the body of the container. The exterior surface of the container neck has four separate screw threads thereon that are complimentary to and mate with the four screw threads of the cap skirt. On opposite sides of the container neck, a stop surface and a detent project upwardly from the annular shoulder and radially outwardly from the neck. A spacing is provided between the stop surface and detent pairs on the opposite sides of the neck. The pair of stop surfaces are diametrically opposite each other, the pair of detents are diametrically opposite each other, and the pair of spacings are diametrically opposite each other. Both the stop surfaces and the detents have a height dimension above the container shoulder, and the height dimension of the stop surfaces is greater than that of the detents.

In attaching the cap to the container neck, the cap skirt threads are mated with the threads of the container neck by positioning the cap skirt above the container opening and rotating the cap skirt one quarter of a turn relative to the container. The one quarter turn mates the four separate threads inside the cap skirt with the four separate threads on the exterior of the container neck and attaches the cap to the container. Because four separate pairs of mating screw threads are employed in attaching the cap to the container, the cap is firmly secured to the container and will not rock relative to the container. Also, because each of the four screw threads on the container neck only extend an arcuate length that is one-quarter of the circumference of the container neck, the cap can be attached to the container by the same mechanism currently being employed in production that positions a bayonet-type cap connector on a liquid container neck and then turns the bayonet-type connector one quarter turn.

The downwardly extending tabs on the cap skirt and the pairs of stop surfaces and detents provided on the container neck ensure that once the cap is secured to the container neck, it will not become unintentionally rotated relative to the container and disconnected. The pair of tabs are positioned so that, as the cap skirt is turned the one quarter turn relative to the container neck, each tab will pass over a detent and be bent radially outwardly by the detent. After the tabs pass over the detents, they come into engagement with the stop surfaces and their resilience causes them to return to their at rest positions occupying the spaces between each stop surface and detent. This securely holds the cap in its attached position on the container neck. In order to remove the cap from the container neck, enough force must be exerted to rotate the cap in the opposite direction and cause the tabs to be bent outwardly to their displaced positions so that they again can pass over the detents when removing the cap from the container neck.

The closure of the invention described above provides a closure for a cap and container, where the cap may be securely attached to the container by turning the cap only one quarter of a turn relative to the container neck while providing a secure connection between the cap and container neck where the cap will not rock relative to the container. In addition, by providing the resilient tabs that engage in the spacings between the stop surfaces and the detents, the cap locks in place on the container neck and cannot inadvertently become disconnected from the container neck.

BRIEF DESCRIPTION OF THE DRAWINGS

Further objects and features of the present invention are set forth in the detailed description of the preferred embodiments of the invention and in the drawing figures wherein.

DESCRIPTION OF THE PREFERRED EMBODIMENTS

Figure 2:
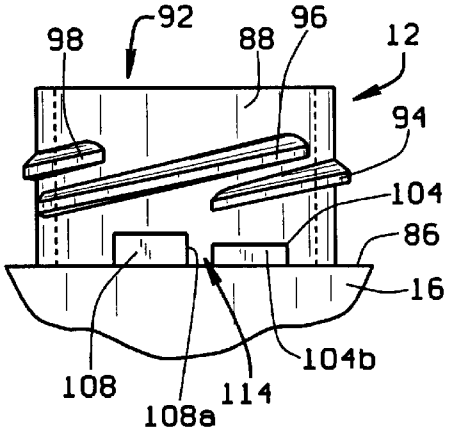
FIG. 2 is a partial elevation view of a container employing the closure of the invention.
Figure 1:
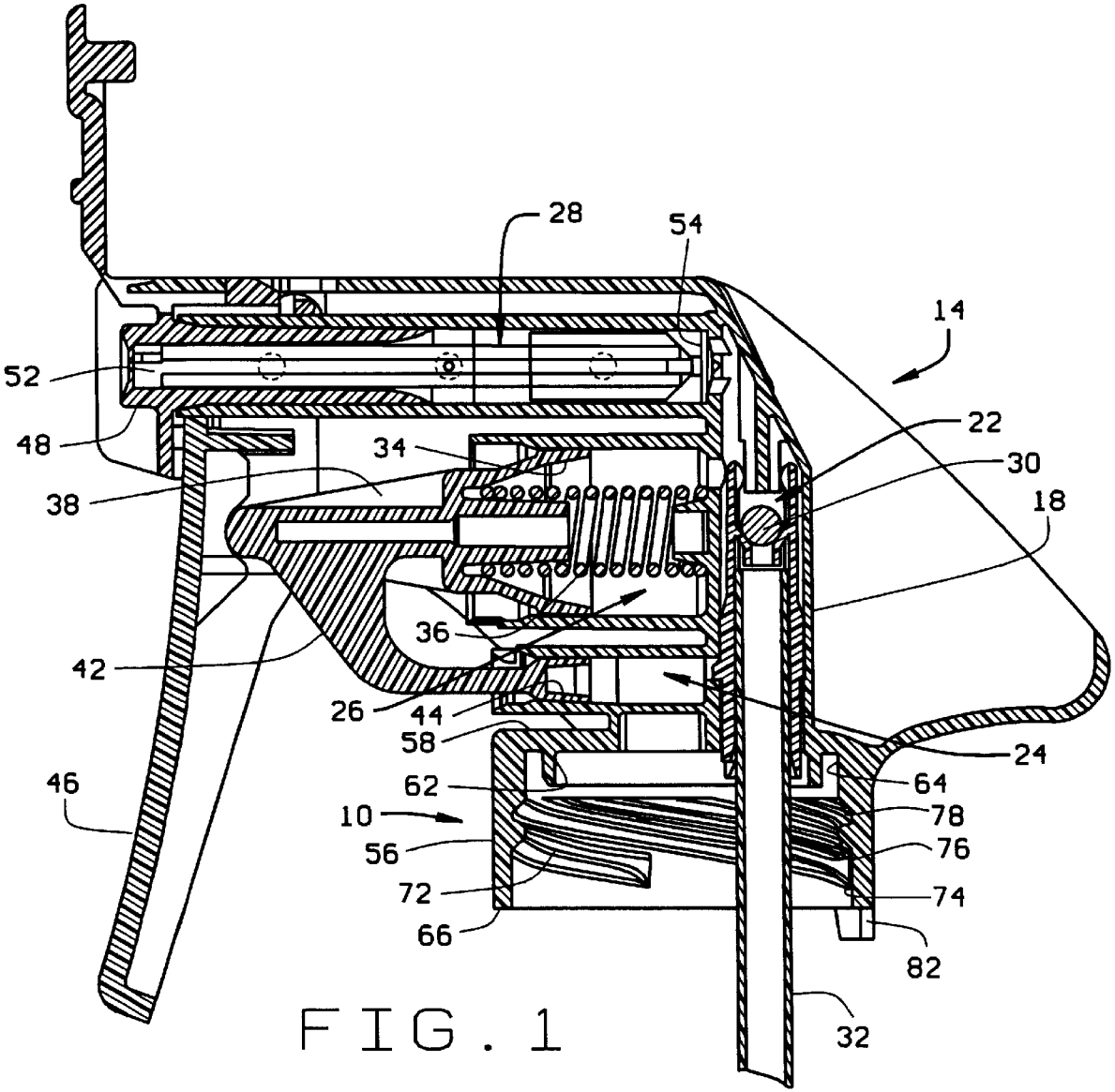
FIG. 1 is a side elevation view in section of a trigger sprayer employing the closure of the invention.

FIGS. 1–5 illustrate the use of the closure of the invention on a trigger sprayer housing and bottle container. It should be understood that this environment in which the closure of the invention is employed is illustrative only and that the closure of the invention may be employed in any other type of environment where it is desired to seal close a bottle neck opening by a cap with only one-quarter turn of the cap on the bottle neck. The closure of the invention is basically comprised of a cap 10 and a bottle neck 12. FIG. 1 shows the cap 10 formed as an integral part of a trigger sprayer 14. FIG. 2 shows the bottle neck 12 provided on a bottle 16 intended to receive the trigger sprayer 14. FIGS. 2–5 show only the cap 10 and bottle neck 12, with the trigger sprayer 14 removed from the cap. It should be understood that where the cap 10 is employed with a trigger sprayer 14, the construction of the closure of the invention permits the cap 10 to be formed integrally as one piece with the trigger sprayer 14, thereby reducing the component parts of the trigger sprayer and accordingly reducing its manufacturing costs.

The trigger sprayer 14 with which the cap 10 is employed may be any type of trigger sprayer and that shown in FIG. 1 is illustrative only and will therefore only be described in general terms. The trigger sprayer 14 includes a housing 18 that is comprised of a liquid supply passage 22, a vent chamber 24, a pump chamber 26, and a liquid discharge passage 28. The liquid supply passage 22, vent chamber 24, pump chamber 26, liquid discharge passage 28 and the cap 10 are all integrally molded with the trigger sprayer housing 18 as one monolithic piece. In variant embodiments, the cap 10 may be attached to the trigger sprayer housing 18 for rotational movement relative thereto as is done in many prior art trigger sprayers.

A dip tube 32 is inserted into the lower end of the liquid supply passage 22 and extends into the interior of the bottle container 16 when the trigger sprayer 14 is attached to the bottle. The dip tube 32 supplies liquid to the liquid supply passage 22 which in turn communicates the liquid to the pump chamber 26 when the pump is actuated. A priming valve 30 controls liquid flow from the dip tube 32 to the pump chamber and prevents flow from the pump chamber to the dip tube.

A pump piston 34 is received in the interior of the pump chamber 26 for reciprocating movement therein. A coil spring 36 biases the pump piston 34 to the left as viewed in FIG. 1 to the charge position of the pump piston 34 relative to the pump chamber 26. The pump piston 34 is moved against the bias of the spring 36 or to the right as viewed in FIG. 1 when moved to its discharge position forcing liquid from the pump chamber, as is conventional. A piston rod 38 extends forwardly from the pump piston 34. An arm 42 extends downwardly from the piston rod 38 and has a vent piston 44 attached at its distal end. The vent piston 44 reciprocates through the vent chamber 24 providing a path of air flow to vent the interior of the bottle container 16 when the pump piston 34 is moved to its discharge position in the pump chamber 26. A trigger 46 is mounted to the trigger sprayer housing 18 for oscillating, pivoting movement relative thereto. The trigger 46 engages with the piston rod 38 and, in response to manual oscillating movement of the trigger 46 on the trigger sprayer housing 18, the piston rod 38 causes the pump piston 34 and vent piston 44 to reciprocate in the pump chamber 26 and vent chamber 24, respectively.

A nozzle assembly 48 is inserted into a downstream end of the liquid discharge passage 28. The liquid discharge passage 28 also contains a liquid spinner 52 and a one way check valve 54.

The above described construction of the trigger sprayer 14 is for the most part conventional, although certain component parts may vary in different types of trigger sprayers. All of these trigger sprayers function in basically the same manner. When attached to a liquid filled container, manual manipulation of the trigger 46 will cause reciprocation of the pump piston 34 in the pump chamber 26 and reciprocation of the vent piston 44 in the vent chamber 24. The reciprocation of the pump piston in the pump chamber first vents air in the pump chamber from the trigger sprayer and then draws liquid from the bottle container through the dip tube 32 and the liquid supply passage 22 to the pump chamber 26. The draw of liquid into the pump chamber 26 is a result of a vacuum created in the pump chamber when the pump piston 34 moves from its discharge position toward its charge position in the pump chamber shown in FIG. 1. On subsequent movement of the trigger and pump piston where the pump piston moves from its charge position shown to its discharge position, the internal volume of the pump chamber is decreased and the liquid drawn into the pump chamber is pumped through the one way check valve 54, the liquid discharge passage 28 and the liquid spinner 52 before being discharged from the nozzle assembly 48.

The cap 10 that forms a part of the closure of the invention has a cylindrical skirt 56 having a smooth, continuous exterior surface with no indentations or apertures often found on prior art bayonet connectors that detract from their aesthetic appearance and feel. A top wall 58 of the cap extends across the top of the skirt 56 and connects the cap integrally with the trigger sprayer housing 18. In the interior of the cap, an annular sealing collar 62 depends downwardly from the top wall 58 a short distance. The diameter of the collar 62 is dimensioned to fit tightly into the interior of the container neck as will be explained. Spaced radially outwardly from the cap collar 62, the interior surface 64 of the cap skirt 56 depends downwardly to a bottom annular edge 66 of the cap. The skirt interior surface 64 is generally cylindrical and smooth except for the presence of four separate helical screw threads 72, 74, 76, 78 formed around the interior surface of the cap skirt that provide a connector of the cap to the container. Each of the four screw threads 72, 74, 76, 78 extends around about one-half of the interior circumference of the skirt 56 and each has a leading edge that is spaced one-quarter of the circumference from the leading edges of the next adjacent threads and each has a trailing edge that is spaced one-quarter of the circumference from the trailing edges of the next adjacent threads. At the bottom of the cap skirt 56, a pair of resilient, flexible tabs 82, 84 depend downwardly from the skirt bottom edge 66. Each of the tabs 82, 84 has an exterior surface that is smooth and continuous with the cap skirt exterior surface. The resilience of the tabs enables them to be bent or displaced from their at rest positions relative to the cap skirt 56 where they extend axially downwardly from the skirt annular edge 66 and do not project radially from the cap skirt, to a displaced position of the cap tabs where they extend both axially downwardly from the cap skirt annular edge 66 and radially outwardly from the cap skirt. The pair of cap tabs 82, 84 are positioned diametrically opposite each other on the cap skirt bottom edge.

The bottle 16 has an annular shoulder 86 at its top and a cylindrical neck 88 that extends upwardly from the shoulder to the bottle neck opening 92. The exterior surface of the bottle neck 88 is cylindrical and smooth except for the presence of four separate screw threads 94, 96, 98, only three of which are visible in the drawings, the fourth being on the opposite side of the neck from the one full thread 96 shown. The four screw threads on the bottle neck are configured complimentary to the screw threads 72, 74, 76, 78 on the interior surface 64 of the cap skirt and provide a connector of the bottle container to the cap. The screw threads 94, 96, 98, of the bottle neck each extend around about one-quarter of the circumference of the bottle neck exterior surface and each has a leading edge that is spaced one-quarter of the bottle neck circumference from the leading edges of the next adjacent threads and each has a trailing edge that is spaced one-quarter of the bottle neck circumference from the trailing edges of the next adjacent threads.

Figure 4:
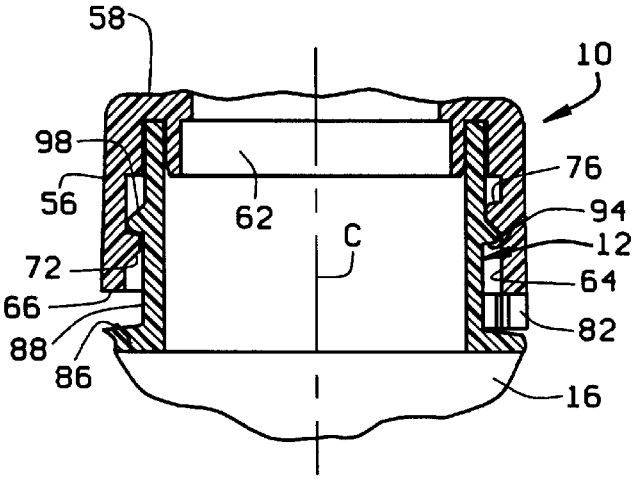
FIG. 4 is a partial elevation view in cross-section showing the closure of the invention.

At the bottom of the bottle neck where the neck 88 adjoins the shoulder 86 are pairs of detents 104, 106 and stops 108, 112. The detents 104, 106 are positioned on diametrically opposite sides of the bottle neck 88 and the stops 108, 112 are also positioned on diametrically opposite sides of the neck. The detents 104, 106 extend axially upward from the bottle shoulder 86 to a first height dimension. As best seen in FIG. 4, the detents 104, 106 also project radially outwardly from the bottle neck 88, but not to the extent of the bottle shoulder 86. As best seen in FIG. 4, each of the detents 104, 106 has opposed surfaces 104*a*, 104*b*, 106*a*, 106*b* that are positioned at an angular orientation relative to a plane passing through the center axis C of the bottle neck 88. This angular orientation of the opposite surfaces of the detents facilities the movement of the cap tabs 82, 84 between their at rest and displaced positions when attaching the cap to the bottle neck and removing the cap from the bottle neck as will be explained. Each of the stops 108, 112 has a stop surface 108*a*, 112*a* that extends radially outwardly from the bottle neck 88 across the bottle shoulder 86. Each of the stop surfaces 108*a*, 112*a* is positioned in a plane parallel to a plane passing through the center axis C of the bottle neck 88. As best seen in FIG. 4, the detents 104, 106 are spaced from the stops 108, 112 providing spacings 114, 116 therebetween. The spacings 114, 116 are sufficiently large to enable the cap tabs 82, 84 to occupy the spacings. The spacings 114, 116 are also diametrically opposite each other. Also, the detents 104, 106 have a lesser vertical height dimension than the stops. This is to enable the cap tabs 82, 84 to pass over the detents when attaching and removing the cap.

In attaching the cap 10 to the container neck 12, the cap skirt threads 72, 74, 76, 78 are mated with the threads 94, 96, 98 of the container neck by positioning the cap skirt above the container opening and rotating the cap skirt one quarter of a turn relative to the container. The one quarter turn mates the four separate threads inside the cap skirt with the four separate threads on the exterior of the container neck and attaches the cap to the container. Because four separate pairs of mating screw threads are employed in attaching the cap to the container, the cap is firmly secured to the container and will not rock relative to the container. Also, because each of the four screw threads on the container neck only extend an arcuate length that is one-quarter of the circumference of the container neck, the cap can be attached to the container by the same mechanism currently being employed in production that positions a bayonet-type cap connector on a liquid container neck and then turns the bayonet-type connector one quarter turn.

The downwardly extending tabs 82, 84 on the cap skirt and the pairs of stop surfaces 108, 112 and detents 104, 106 provided on the container neck ensure that once the cap is secured to the container neck, it will not become unintentionally rotated relative to the container and disconnected. The pair of tabs, 82, 84 are positioned so that, as the cap skirt is turned the one quarter turn relative to the container neck, each tab will pass over a detent 104, 106 and be bent radially outwardly by the detent. The sliding of the tabs 82, 84 over the detents 104, 106 is facilitated by the angled surfaces 104*a*, 106*a* of the detents and also because the detents do not project radially outwardly to the extent of the shoulder 86. After the tabs pass over the detents, they come into engagement with the stop surfaces 108*a*, 112*a* and their resilience causes them to return to their at rest positions occupying the spaces 114, 116 between each stop surface and detent. This securely holds the cap in its attached position on the container neck. In order to remove the cap from the container neck, enough force must be exerted to rotate the cap in the opposite direction and cause the tabs 82, 84 to be bent outwardly to their displaced positions so that they again can pass over the detents when removing the cap from the container neck. This bending of the tabs is facilitated by the other angled surfaces 104*b*, 106*b* of the detents.

With the cap 10 in its closed position on the container neck 12, the sealing collar 62 extends through the bottle container opening 92 and into the interior of the neck 12. As best seen in FIG. 4, the cap interior surface 64 toward the top of the cap has a circumference dimensioned to fit tightly around the exterior surface of the bottle neck 12, and the sealing collar 62 has an exterior circumference dimensioned to fit tightly into the interior of the bottle neck 12, thereby providing a seal of the bottle neck opening 92.

Figure 6:
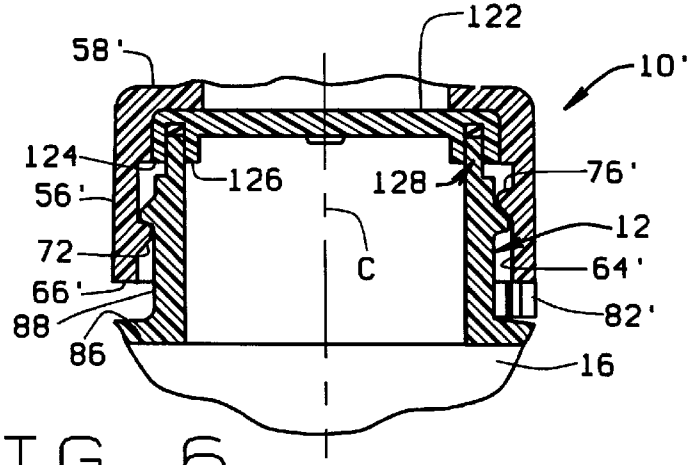
FIG. 6 is a partial elevation view in cross section showing a variant embodiment of the closure of the invention employed with a gasket.
Figure 3:
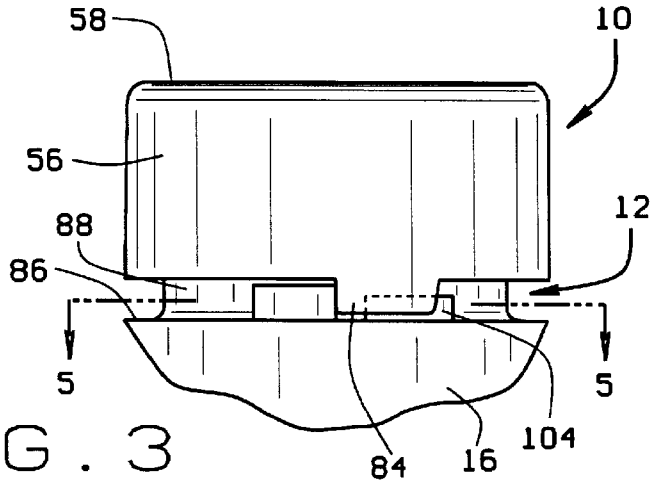
FIG. 3 is a partial side elevation view showing the closure of the invention.
Figure 5:
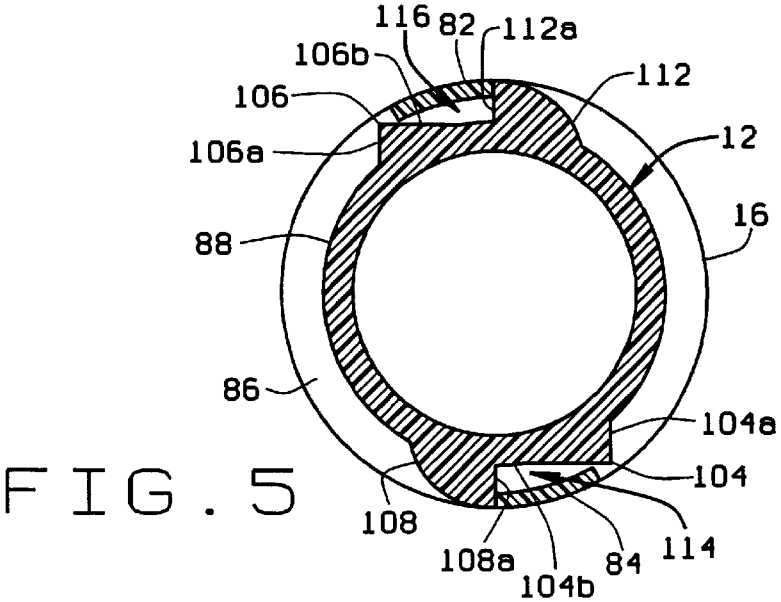
FIG. 5 is a partial plan view in section showing the closure of the invention.

FIG. 6 shows an alternate embodiment of the cap where like component parts of the cap are identified by the same reference numbers used to identify component parts of the previously described embodiment of the cap, but followed by a prime (′). The container neck 12 shown in FIG. 6 is the same as that shown with reference to the previously described embodiments. In the embodiment of the cap 10′ shown in FIG. 6, the cap sealing collar 62 is removed. In its place is a sealing gasket 122. The gasket 122 has a circular periphery dimensioned to fit tightly within the interior circumference of the cap 10′ just below the cap top wall 58′. On the underside of the gasket around its periphery is a downwardly projecting outer rim 124 and a downwardly projecting inner rim 126. Between the two rims is an annular groove 128 that is dimensioned to receive the top of the bottle neck 88′ therein. The engagement of the outer rim 124 of the gasket around the outside of the bottle neck 88 and the engagement of the inner rim 126 of the gasket around the interior of the bottle neck provides a liquid seal between the cap 10′ and the bottle neck 12 when the cap is attached to the bottle. Apart from the presence of the gasket 122 and the absence of the sealing collar 62, the cap 10′ is identical to the cap 10 of the previously described embodiment.

The closure of the invention described above provides a closure for a cap and container, where the cap may be securely attached to the container by turning the cap only one quarter of a turn relative to the container neck while providing a secure connection between the cap and container neck where the cap will not rock relative to the container. In addition, by providing the resilient tabs that engage in the spacings between the stop surfaces and the detents, the cap locks in place on the container neck and cannot inadvertently become disconnected from the container neck.

While the present invention has been described by reference to a specific embodiment, it should be understood that modifications and variations of the invention may be constructed without departing from the scope of the invention defined in the following claims.

What is claimed is:

1. A closure comprising:

a cap having a cylindrical skirt, the skirt having a tab projecting from the skirt and a cap connector inside the skirt;

a container having an opening and a cylindrical neck surrounding the opening, a stop surface extends radially outwardly from the neck, a detent extends radially outwardly from the neck with a spacing between the stop surface and the detent, and a neck connector is on the neck that mates with the cap connector and has a configuration that directs the cap tab to pass over the detent and engage against the stop surface with the tab occupying the spacing between the stop surface and the detent when the cap is attached to the neck.

2. The closure of claim 1, wherein:

the cap connector is at least one screw thread and the neck connector is at least one screw thread.

3. The closure of claim 1, wherein:

the cap connector is four separate screw threads and the neck connector is four separate screw threads.

4. The closure of claim 1, wherein:

the tab is resilient and bendable from an at rest position where the tab projects downwardly from the skirt and does not project radially outwardly from the skirt, to a displaced position where the tab projects downwardly and radially outwardly from the skirt, and the detent extends radially outwardly from the neck a distance that causes the detent to bend the cap tab from its at rest position to its displaced position as the cap tab passes over the detent when the cap is attached to the neck.

5. The closure of claim 1, wherein:

the cap skirt has a planar, annular bottom edge and the tab projects from the bottom edge.

6. The closure of claim 5, wherein:

the cap has a center axis and the tab projects axially from the bottom edge.

7. The closure of claim 1, wherein:

the stop surface, detent and spacing are each one of a pair of stop surfaces, detents and spacings on the bottle neck, and each of the pair of stop surfaces, detents and spacings are positioned diametrically opposite each other.

8. The closure of claim 1, wherein:

the container neck has a center axis and the stop surface is parallel with the center axis.

9. The closure of claim 1, wherein:

the container neck has a center axis and the stop surface and the detent each have an axial dimension, and the axial dimension of the stop surface is larger than the axial dimension of the detent.

10. The closure of claim 1, wherein:

a trigger sprayer housing is attached integrally with the cap preventing the cap from moving relative to the trigger sprayer housing.

11. The closure of claim 10, wherein:

the trigger sprayer housing and the cap have been molded monolithically together.

12. The closure of claim 1, wherein:

the cap skirt has a smooth, continuous exterior surface with no indentations.

13. A closure comprising:

a cap having a cylindrical skirt with a smooth, continuous exterior surface with no indentations, an interior surface with a cap connector thereon, an annular bottom edge around the skirt and a tab projecting downwardly from the bottom edge;

a container having an opening, a cylindrical neck surrounding the opening and an annular shoulder surrounding a bottom of the neck, a stop surface extending upwardly from the shoulder, a detent extending upwardly from the shoulder with a spacing between the stop surface and the detent, and a neck connector on the neck that has a configuration complimentary to the cap connector and that directs the cap tab to pass over the detent and engage against the stop surface occupying the spacing between the stop surface and the detent when the cap is attached to the neck.

14. The closure of claim 13, wherein:

the cap connector and the neck connector are each four separate screw threads.

15. The closure of claim 13, wherein:

the cap tab is bendable from an at rest position where it extends downwardly from the skirt bottom edge to a displaced position where it extends radially outwardly from the skirt bottom edge, and the detent is positioned radially outwardly from the neck in a position where it will contact and bend the tab to its displaced position as the tab passes over the detent when attaching the cap to the container neck.

16. The closure of claim 15, wherein:

the cap tab is resilient and the resilience of the tab causes it to return to its at rest position from its displaced position as the tab is moved from over the detent to the spacing between the detent and the stop surface when attaching the cap to the container neck.

17. The closure of claim 13, wherein:

the detent is one of a pair of detents positioned on diametrically opposite sides of the neck, the stop surface is one of a pair of stop surfaces positioned on diametrically opposite sides of the neck, and the spacing is one of a pair of spacings positioned on diametrically opposite sides of the neck.

18. The closure of claim 13, wherein:

the stop surface extends upwardly from the shoulder to a height of a first dimension and the detent extends upwardly from the shoulder to a height of a second dimension that is smaller than the first dimension.

19. The closure of claim 13, wherein:

a trigger sprayer housing is attached integrally to the cap as one piece.

20. A closure comprising:

a cap having a cylindrical skirt with a smooth, continuous exterior surface having no indentation;

a container having an opening and a cylindrical neck surrounding the opening;

means on both the cap and the container neck for attaching the cap on the container neck by turning the cap only one quarter of a complete revolution on the container neck;

and a tab projects from the cap skirt and the container neck has a stop surface and a detent thereon with a spacing therebetween, and the tab is positioned on the cap where it will pass over the detent, engage against the stop surface and occupy the spacing when the cap is turned one quarter of a complete revolution on the container neck.

21. The closure of claim 20, wherein:

the means on the cap and container for attaching the cap on the container includes four separate helical threads inside the cap skirt and four separate helical threads on the container neck.

22. The closure of claim 21, wherein:

each of the threads on the container neck have an arcuate length that extends for one quarter of a circle.

23. The closure of claim 20, wherein:

a trigger sprayer housing is integrally attached to the cap.

24. The closure of claim 20, wherein:

the cap tab is bendable from an at rest position where it extends downwardly from the skirt bottom edge to a displaced position where it extends radially outwardly from the skirt bottom edge, and the detent is positioned radially outwardly from the neck in a position where it will contact and bend the tab to its displaced position as the tab passes over the detent when attaching the cap to the container neck.

25. The closure of claim 20, wherein:

the detent is one of a pair of detents positioned on diametrically opposite sides of the neck, the stop surface is one of a pair of stop surfaces positioned on diametrically opposite sides of the neck, and the spacing is one of a pair of spacings positioned on diametrically opposite sides of the neck.

26. A closure for a container neck surrounding an opening of a container, the container neck having a stop surface and a detent projecting radially outwardly from the neck with a spacing therebetween, and a neck connector on the container neck, the closure comprising:

a cap having a cylindrical skirt with a smooth, continuous exterior surface with no indentations, an annular bottom edge around the skirt and a tab projecting downwardly from the bottom edge, and an interior surface with a cap connector thereon, the cap connector having a configuration complimentary to the neck connector and that directs the cap tab to pass over the detent and engage against the stop surface occupying the spacing between the detent and the stop surface when the cap is attached to the neck.

27. The closure of claim 26, wherein:

the cap connector is four separate screw threads.

28. The closure of claim 26, wherein:

the cap tab is one of a pair of cap tabs on diametrically opposite sides of the cap.

29. The closure of claim 26, wherein:

a trigger sprayer housing is attached integrally to the cap as one piece.

30. A closure for receiving a cap thereon, the cap having a cylindrical skirt with an annular bottom edge around the skirt and a tab projecting downwardly from the bottom edge, and an interior surface with a cap connector thereon, the closure comprising:

a container having a cylindrical neck surrounding an opening of the container, a stop surface extending radially outwardly from the container neck, a detent extending radially outwardly from the container neck with a spacing between the stop surface and the detent; and a neck connector on the container neck that has a configuration complimentary to the cap connector for directing the cap tab to pass over the detent and engage against the stop surface occupying the spacing between the stop surface and the detent when the cap is attached to the container neck.

31. The closure of claim 30, wherein:

the neck connector is four separate screw threads.

32. The closure of claim 30, wherein:

the detent is one of a pair of detents positioned on diametrically opposite sides of the neck, the stop surface is one of a pair of stop surfaces positioned on diametrically opposite sides of the neck, and the spacing is one of a pair of spacings positioned on diametrically opposite sides of the neck.

33. The closure of claim 30, wherein:

the container neck has a center axis and the stop surface and the detent each have an axial dimension, and the axial dimension of the stop surface is larger than the axial dimension of the detent.

* * * * *